US010737846B2

(12) United States Patent
Tsuzuki et al.

(10) Patent No.: US 10,737,846 B2
(45) Date of Patent: Aug. 11, 2020

(54) SYNTHETIC RESIN CAP FOR CARBONATED BEVERAGE-FILLED CONTAINER, CLOSURE DEVICE, AND BEVERAGE-CONTAINING CLOSURE DEVICE

(71) Applicant: Closure Systems International Japan, Limited, Tokyo (JP)

(72) Inventors: Mitsuo Tsuzuki, Shimotsuga-gun (JP); Fuminori Takazawa, Shimotsuga-gun (JP); Shoji Yamamoto, Shimotsuga-gun (JP)

(73) Assignee: Closure Systems International Japan, Limited, Tokyo (JP)

( * ) Notice: Subject to any disclaimer, the term of this patent is extended or adjusted under 35 U.S.C. 154(b) by 29 days.

(21) Appl. No.: 14/359,186

(22) PCT Filed: Oct. 10, 2012

(86) PCT No.: PCT/JP2012/076204
§ 371 (c)(1),
(2) Date: May 19, 2014

(87) PCT Pub. No.: WO2013/077099
PCT Pub. Date: May 30, 2013

(65) Prior Publication Data

US 2014/0319144 A1 Oct. 30, 2014

(30) Foreign Application Priority Data

Nov. 21, 2011 (JP) ..... 2011-253824

(51) Int. Cl.
*B65D 41/34* (2006.01)
*B65D 41/04* (2006.01)
*B65D 41/32* (2006.01)

(52) U.S. Cl.
CPC ..... *B65D 41/0421* (2013.01); *B65D 41/0428* (2013.01); *B65D 41/325* (2013.01); *B65D 41/3447* (2013.01)

(58) Field of Classification Search
CPC ..... B65D 41/0421; B65D 41/0428; B65D 41/325; B65D 41/3447
(Continued)

(56) References Cited

U.S. PATENT DOCUMENTS 5,161,707 A 11/1992 Dutt et al.
6,695,161 B2 2/2004 Kano et al.
(Continued)

FOREIGN PATENT DOCUMENTS

CA 1196606 A 11/1985
CA 1196606 A1 11/1985
(Continued)

OTHER PUBLICATIONS

International Search Report dated for Dec. 4, 2012 the corresponding PCT Application No. PCT/JP2012/076204.
(Continued)

*Primary Examiner* — Elizabeth J Volz
(74) *Attorney, Agent, or Firm* — Nixon Peabody LLP

(57) ABSTRACT

A synthetic resin cap mounted on a lip section of a container filled with a carbonated beverage includes a top plate section and a cylindrical section extending downward from a circumferential edge of the top plate section. An annular inner seal projection fitted into the lip section and an outer seal projection abutting an outer surface of the lip section are formed at an inner surface of the top plate section. An annular abutting convex section abutting the inner surface of the lip section is formed at an outer surface of the inner seal projection. The outer seal projection has an inner surface having an inner diameter reduced toward a distal end, and a
(Continued)

minimum inner diameter section, which is a lower end of the inner surface, abuts the outer surface of the lip section at a position spaced apart from an opening end section toward a container main body.

38 Claims, 6 Drawing Sheets

(58) Field of Classification Search
USPC ..... 220/304, 288, 240; 215/344, 341, 270, 215/346, 354, 44, 45
See application file for complete search history.

(56) References Cited

U.S. PATENT DOCUMENTS

| | | | | |
|---|---|---|---|---|
| 7,850,029 | B2 * | 12/2010 | Dreyer | B65D 41/0421 215/329 |
| 2004/0060893 | A1 * | 4/2004 | Kano et al. | 215/344 |
| 2011/0024423 | A1 * | 2/2011 | Erspamer | B65D 41/3428 220/266 |

FOREIGN PATENT DOCUMENTS

| | | | | |
|---|---|---|---|---|
| CN | 1313233 | A * | 9/2001 | B65D 41/04 |
| CN | 1313233 | A | 9/2001 | |
| DE | 3139526 | * | 4/1983 | B65D 41/0428 |
| EP | 2226264 | A1 | 9/2010 | |
| FR | 2863589 | A1 | 6/2005 | |
| JP | 58-073551 | A | 5/1983 | |
| JP | 2002-211605 | A | 7/2002 | |
| JP | 2003-175948 | A | 6/2003 | |
| JP | 2004-352360 | A | 12/2004 | |
| JP | 2005-053580 | A | 3/2005 | |
| JP | 2009-208778 | A | 9/2009 | |
| WO | WO 2007/132254 | A1 | 11/2007 | |

OTHER PUBLICATIONS

Office Action dated Feb. 28, 2015 for the corresponding Chinese Application No. 201280056115.1.
Notice of Allowance dated Jun. 28, 2016 for the corresponding Japanese Patent Application No. 2011-253824.
Drawing of "Ribbed Top Panel"; allegedly provided at Plastic Cap and Closures North America Conference, Atlanta, Georgia; Sep. 12-14, 2011 (1 page).
Brochure: "Compression Technology for plastic closures"; SACMI, allegedly published in Oct. 2010 (20 pages).
"Latest developments for CSD Beverages in the field of PCO1881: Full range of single-piece closures"; allegedly taken from SACMI presentation at 2011 Packaging Conference, Las Vegas, Nevada; Feb. 7-9, 2011 (1 page).
"Latest Closures Developments in PCO1881"; allegedly from SACMI Open House presentation, Imola, Italy; Mar. 31, 2011 (1 page).

* cited by examiner

SYNTHETIC RESIN CAP FOR CARBONATED BEVERAGE-FILLED CONTAINER, CLOSURE DEVICE, AND BEVERAGE-CONTAINING CLOSURE DEVICE

CROSS-REFERENCE TO RELATED PATENT APPLICATIONS

This application is a U.S. National Phase Application under 35 U.S.C. § 371 of International Patent Application No. PCT/JP2012/076204, filed Oct. 10, 2012, and claims the benefit of Japanese Patent Application No. 2011-253824, filed on Nov. 21, 2011, all of which are incorporated by reference in their entirety herein. The International Application was published in Japanese on May 30, 2013 as International Publication No. WO/2013/077099, under PCT Article 21(2).

FIELD OF THE INVENTION

The present invention relates to a synthetic resin cap to close a container lip section, a closure device using the same, and a beverage-containing closure device, and more particularly, a synthetic resin cap used in a container filled with a carbonated beverage, a closure device using the same, and a beverage-containing closure device.

BACKGROUND OF THE INVENTION

As a synthetic resin cap (hereinafter, simply referred to as a cap) used in a container filled with a carbonated beverage, there is a cap including a top plate section and a cylindrical section extending downward from a circumferential edge of the top plate section, wherein a threaded section is formed at an inner surface of the cylindrical section (for example, see Japanese Unexamined Patent Application, First Publication No. 2002-211605).

FIG. 6 shows an example of the cap, in which the cap 31 includes a top plate section 32 and a cylindrical section 33 extending downward from a circumferential edge of the top plate section 32, and a threaded section 40 fitted onto an external thread 22 of a lip section 21 of a container 20 is formed at an inner surface of the cylindrical section 33. The container 20 is formed of polyethylene terephthalate (PET) or the like.

An inner seal projection 42 fitted into the lip section 21 of the container 20 to abut an inner surface 21*a* of the lip section 21 and an outer seal projection 44 abutting a portion from an opening end surface 21*b* of the lip section 21 to an outer surface 21*c* are formed at an inner surface of the top plate section 32. The inner and outer seal projections 42 and 44 abut the lip section 21 of the container 20 to seal the container 20. In particular, the outer seal projection 44 comes in contact with the container 20 with a pressing force stronger than that of the inner seal projection 42 to become a main constituent of sealing.

Since the cap 31 is used in the container 20 filled with the carbonated beverage, an inner pressure of the container 20 is increased so that the top plate section 32 is expanded and deformed upward. Since the inner seal projection 42 is also moved upward when the top plate section 32 is expanded and deformed, in consideration of this, the inner seal projection 42 is designed to abut the inner surface 21*a* at a low position.

FIG. 7 is an example of another cap, in which the cap 51 includes a cap main body 54 constituted of a top plate section 52 and a cylindrical section 53 extending downward from a circumferential edge of the top plate section 52, and a threaded section 60 is formed at an inner surface of the cylindrical section 33. An inner seal projection 62 configured to abut the inner surface 21*a* of the lip section 21 and an opening end seal projection 63 configured to abut a portion from the opening end surface 21*b* of the lip section 21 to the outer surface 21*c* are formed at an inner surface of the top plate section 52. The opening end seal projection 63 seals the lip section 21 in a state pressed by the lip section 21 of the container 20 upon capping and bent and deformed outward in a radial direction until abutting the cap main body 54 (for example, see Japanese Unexamined Patent Application, First Publication No. 2003-175948).

Problem to be Solved by the Invention

Since the cap 31 or 51 is used in the container 20 filled with the carbonated beverage, as the inner pressure of the container 20 is increased, higher sealing performance is required.

However, the dimensions (an inner diameter, an outer diameter, or the like) of the lip section 21 of the container 20 vary according to a variation in environmental temperature, and this variation applies an influence on sealing performance of the cap 31 or 51. In addition, when an impact is applied from the outside, sealability of the outer seal projection 44 is decreased and sealing performance is decreased.

In addition, conventionally, while a lubricant (erucic acid amide or the like) is added to the cap 31 or 51 to accomplish appropriate uncapping and capping properties, in a cleaning process before packing of a content fluid into the container 20, the lubricant on the surface of the cap 31 or 51 may be washed away, and a sufficient effect of the lubricant cannot be obtained. In addition, since a bleeding amount of the lubricant on the surface of the cap 31 or 51 varies due to a variation caused by a time after manufacture, season, or the like, a function of the lubricant cannot be appropriately and easily exhibited.

For this reason, a cap by which appropriate uncapping and capping properties can be obtained even without adding a lubricant is required.

SUMMARY OF THE INVENTION

In consideration of the above-mentioned circumstances, the present invention is directed to provide a cap for a container filled with a carbonated beverage capable of preventing a decrease in sealing performance due to a variation in environmental temperature and an impact from the outside, and obtaining appropriate uncapping and capping properties even without adding a lubricant, a closure device using the cap, and a beverage-containing closure device.

The present invention provides a synthetic resin cap for a carbonated beverage-filled container, which is configured to be mounted on a lip section of a container filled with a carbonated beverage. The synthetic resin cap for a carbonated beverage-filled container includes: a top plate section and a cylindrical section extending downward from a circumferential edge of the top plate section, wherein an inner seal projection fitted into the lip section and an outer seal projection configured to abut an outer surface of the lip section are formed at an inner surface of the top plate section, an abutting convex section configured to abut an inner surface of the lip section and seal the container is formed at an outer surface of the inner seal projection at a position spaced apart from an opening end section of the lip section toward a container main body, the outer seal projection has an inner surface having an inner diameter reduced toward a distal end, and a minimum inner diameter section, which is a lower end of the inner surface, abuts the outer surface of the lip section at a position spaced apart from the opening end section of the lip section toward the container main body.

The minimum inner diameter section of the outer seal projection may be disposed at a position higher than a maximum outer diameter section of an abutting convex section of the inner seal projection.

The outer seal projection may be formed in a plate shape.

A height difference between the minimum inner diameter section and the maximum outer diameter section may be 2.5 mm or less.

The outer seal projection may have an average thickness from a base end section to the minimum inner diameter section of 0.5 to 2 mm.

In the synthetic resin cap for a carbonated beverage-filled container, a thin wall section that is thinner than other portions may be formed at a position close to a base end section of the inner seal projection.

In the synthetic resin cap for a carbonated beverage-filled container, a lubricant may not be added.

The present invention provides a closure device including a container filled with a carbonated beverage and a synthetic resin cap mounted on a lip section of the container, wherein the synthetic resin cap includes a top plate section and a cylindrical section extending downward from a circumferential edge of the top plate section, and wherein an inner seal projection fitted into the lip section and an outer seal projection abutting an outer surface of the lip section are formed at an inner surface of the top plate section, an abutting convex section to abut an inner surface of the lip section and seal the container is formed at an outer surface of the inner seal projection at a position spaced apart from an opening end section of the lip section toward a container main body, the outer seal projection has an inner surface having an inner diameter reduced toward a distal end, and a minimum inner diameter section, which is a lower end of the inner surface, abuts the outer surface of the lip section at a position spaced apart from the opening end section of the lip section toward the container main body.

The present invention provides a beverage-containing closure device including a container filled with a carbonated beverage and a synthetic resin cap mounted on a lip section of the container, wherein the synthetic resin cap includes a top plate section and a cylindrical section extending downward from a circumferential edge of the top plate section, and wherein an inner seal projection fitted into the lip section and an outer seal projection abutting an outer surface of the lip section are formed at an inner surface of the top plate section, an abutting convex section to abut an inner surface of the lip section and seal the container is formed at an outer surface of the inner seal projection at a position spaced apart from an opening end section of the lip section toward a container main body, the outer seal projection has an inner surface having an inner diameter reduced toward a distal end, and a minimum inner diameter section, which is a lower end of the inner surface, abuts the outer surface of the lip section at a position spaced apart from the opening end section of the lip section toward the container main body.

Effects of the Invention

According to the present invention, since the outer seal projection has the inner surface having an inner diameter reduced toward the distal end and abuts the outer surface of the lip section at the lower end, a following deformation property can be provided to the outer seal projection.

Accordingly, the abutting state with respect to the outer surface of the lip section can be maintained even when an impact is applied from the outside, and a decrease in sealing performance can be prevented.

In the cap for the carbonated beverage, since a position of the inner seal projection abutting the container is designed to be relatively low in consideration of expanding and deforming due to the inner pressure of the container, inward deformation of the lip section of the container is likely to occur. On the other hand, according to the present invention, since the abutting position of the outer seal projection with respect to the lip section outer surface is decreased and the difference in height between the lip section pressing positions of the outer seal projection and the inner seal projection can be reduced, inward deformation of the lip section of the container can be prevented even when the environmental temperature is increased, and a decrease in sealing performance can be prevented.

According to the present invention, since the outer seal projection abuts the lip section closer to the distal end than the base end section, the pressing force with respect to the lip section is easily set to a lower level in comparison with the case in which the abutting position is the base end section. For this reason, a ratio between the pressing forces of the outer seal projection and the inner seal projection can be optimized and inward deformation of the lip section can be prevented.

In the present invention, since the inward pressing force of the outer seal projection can be decreased by the structure of the above-mentioned outer seal projection without decreasing the sealing performance, the uncapping torque and the capping torque can be suppressed and the uncapping property and the capping property can be improved. For this reason, no lubricant is required. While lubricants cannot easily and properly exhibit these functions (for example, suppression of the uncapping torque and the capping torque), since no lubricant is required in the present invention, stable uncapping and capping properties can be obtained.

Further, in the present invention, a phenomenon in which the carbonated beverage abruptly foams and spills out of the lip section does not occur upon the uncapping. According to the present invention, although it is not clear why the phenomenon in which the carbonated beverage spills out is prevented, it may be related to the fact that no lubricant is required.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Embodiments of the Invention

Figure 1A:
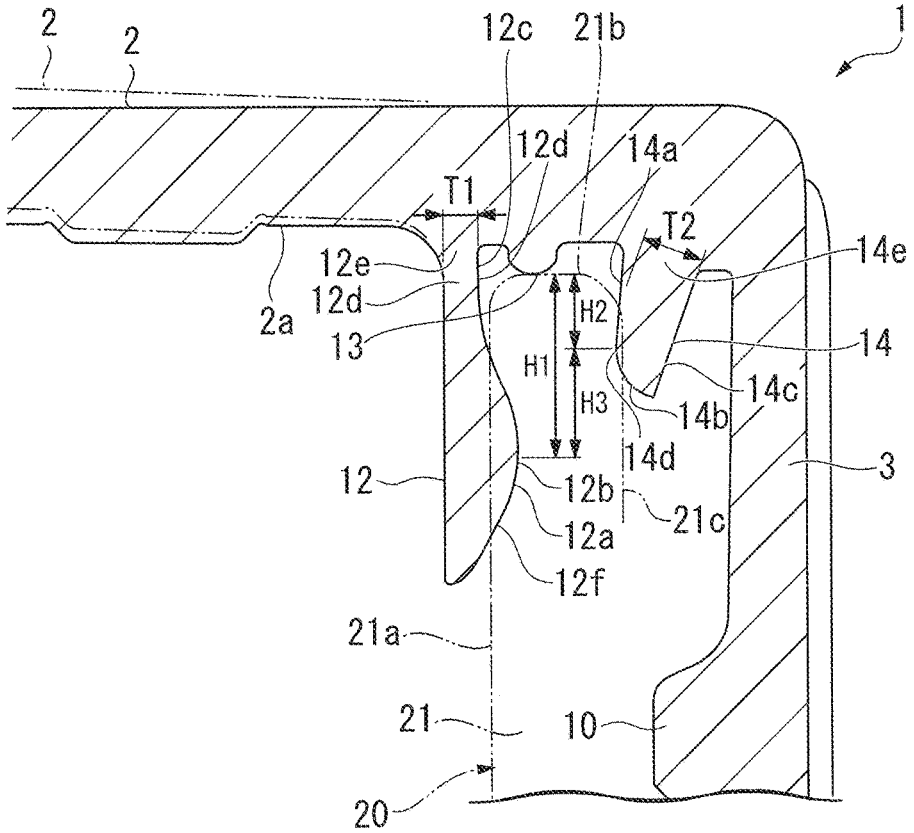
FIG. 1A is an enlarged cross-sectional view of an embodiment of a synthetic resin cap of the present invention, showing the cap, which is not mounted on a lip section of a container.
Figure 1B:
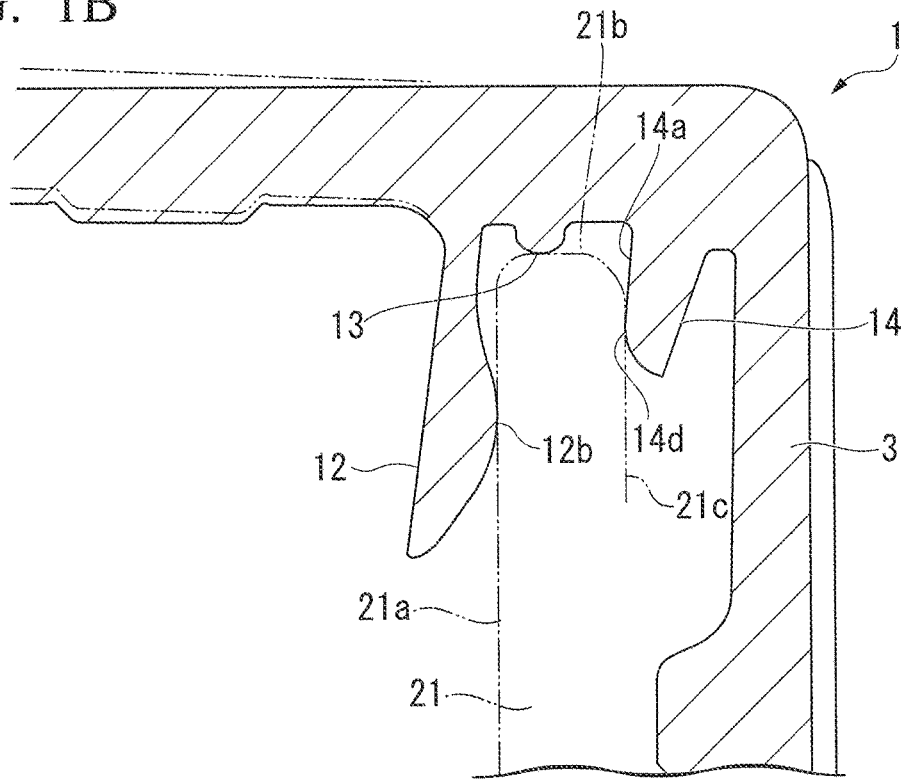
FIG. 1B is an enlarged cross-sectional view of the embodiment of the synthetic resin cap of the present invention of FIG. 1A, showing the cap, which is mounted on the lip section of the container.
Figure 2:
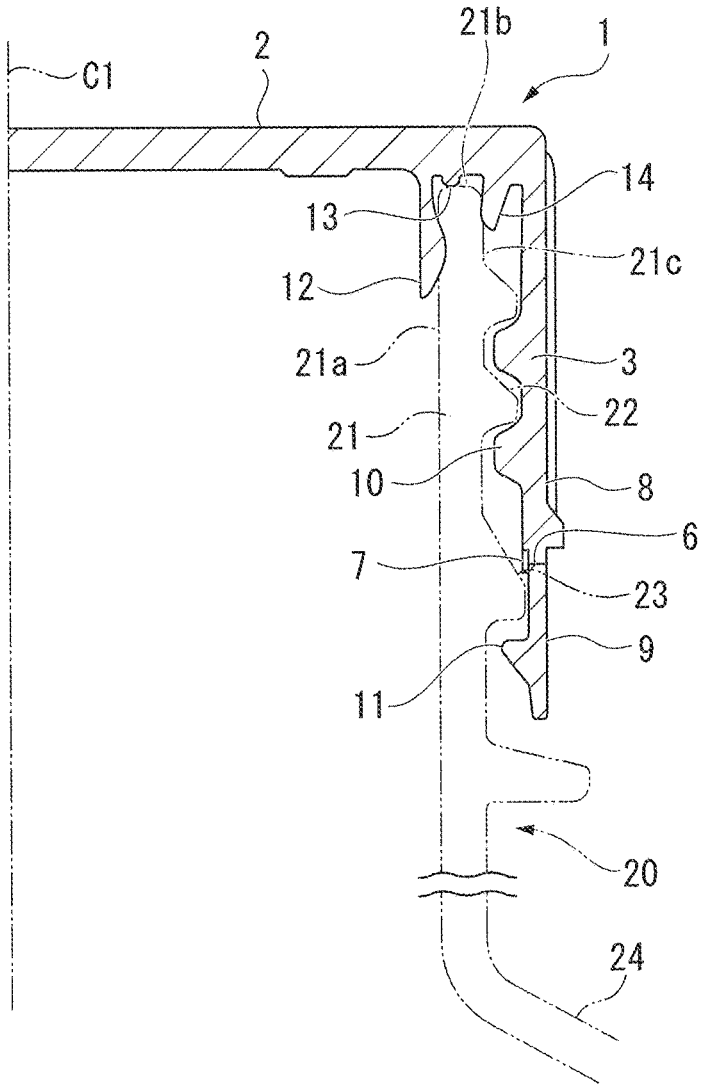
FIG. 2 is a cross-sectional view showing the entire synthetic resin cap of the above-mentioned drawings.

FIGS. 1A, 1B and 2 show an embodiment of a synthetic resin cap and a closure device of the present invention. Here, the closure device is constituted by a container 20, and a synthetic resin cap 1 (hereinafter, simply referred to as a cap 1) mounted on a lip section 21 of the container 20.

FIG. 1A shows the cap 1, which is not mounted on the lip section 21, and FIG. 1B shows the cap 1, which is mounted on the lip section 21.

Reference character C1 of FIG. 2 represents a central axis of the cap 1. In the following description, upward and downward directions are upward and downward directions in FIGS. 1A, 1B and 2, and directions along the central axis C1. A height direction is also a height direction in FIGS. 1A, 1B and 2, and a direction along the central axis C1.

The container 20 is formed of a synthetic resin, for example, polyethylene terephthalate (PET) or the like, and has a container main body 24 filled with a beverage, and the lip section 21 formed at an upper portion thereof.

An external thread 22 is formed at an outer surface 21*c* of the lip section 21. An engaging step section 23 formed at a lower side of the external thread 22 is an annular projection projecting outward in a radial direction.

An inner surface 21*a* and the outer surface 21*c* of the shown example are surfaces in an axial direction of the container 20. An opening end surface 21*b* is a surface perpendicular to the axial direction of the container 20.

The cap 1 includes a circular top plate section 2, and a cylindrical section 3 extending downward from a circumferential edge of the top plate section 2.

The cylindrical section 3 is divided into a main section 8 and a tamper evidence ring section (a TE ring section) 9 connected to the main section 8 via a bridge 7 (see FIG. 2) by a score 6 (a weakened section).

A threaded section 10 threadedly engaged with the external thread 22 of the container 20 is formed at an inner circumferential surface of the main section 8.

The threaded section 10 is a protrusion set formed of one set or a plurality of sets of spiral shapes.

As shown in FIGS. 1A and 1B, the top plate section 2 has an annular inner seal projection 12 fitted into the lip section 21 of the container 20 to abut the inner surface 21*a* of the lip section 21, an annular opening end seal projection 13 abutting the opening end surface 21*b* of the lip section 21, and an annular outer seal projection 14 abutting the outer surface 21*c* of the lip section 21.

The inner seal projection 12 is formed to extend downward from an inner surface 2*a* (a lower surface) of the top plate section 2.

In an outer surface 12*f* of the inner seal projection 12, an annular abutting convex section 12*a* abutting the container inner surface 21*a* is formed at a position spaced downward apart from a base end section 12*e* (i.e., in an extending direction of the inner seal projection 12). A cross-sectional shape of the abutting convex section 12*a* may be a curved shape such as substantially an arc shape, substantially an oval arc shape, or the like.

The inner seal projection 12 is configured to abut the inner surface 21*a* throughout the entire circumference with no gap and close (seal) the container 20 at a position at which a maximum outer diameter section 12*b* of the abutting convex section 12*a* is spaced apart from the opening end surface 21*b* toward the container main body 24 upon insertion into the lip section 21. An outer diameter of the maximum outer diameter section 12*b* may be slightly larger than an inner diameter of the lip section 21. Accordingly, since the inner seal projection 12 abuts the inner surface 21*a* merely by being elastically bent and curved inward, the inner seal projection 12 abuts the inner surface 21*a* with a sufficient pressing force.

A weakened concave section 12*c* is formed at the base end section 12*e* of the inner seal projection 12 and the outer surface 12*f* in the vicinity thereof throughout the entire circumference, and the inner seal projection 12 of a portion at which the weakened concave section 12*c* is formed becomes a thin wall section 12*d* that is thinner than other portions. The thin wall section 12*d* may be formed at a position near the base end section 12*e*.

A thickness of the thin wall section 12*d*, i.e., a thickness T1 shown in FIG. 1A, may be 1 to 2.2 mm (preferably 1.2 to 2 mm, more preferably 1.4 to 1.8 mm). If the thickness of the thin wall section 12*d* is within this range, since flexibility can be applied to the thin wall section 12*d*, even when the top plate section 2 is expanded and deformed upward upon an increase in inner pressure of the container 20, the inner seal projection 12 cannot be easily deformed inward, and sealability of the inner seal projection 12 is increased.

In addition, if the thickness of the thin wall section 12*d* is within this range, sufficient stiffness that deformation (buckling deformation or the like) does not occur upon fitting into the lip section 21 can be provided to the inner seal projection 12.

A height position of the maximum outer diameter section 12*b* of the inner seal projection 12 may be set such that a height difference H1 between the maximum outer diameter section 12*b* and a lower end (a projection end) of the opening end seal projection 13 is 1 to 4 mm (preferably 1.5 to 3 mm).

When the height difference H1 is too small, as shown by two-dot chain lines of FIGS. 1A and 1B, a tamper evidence property is decreased when the top plate section 2 is expanded and deformed upward and the inner seal projection 12 is moved upward by the increase in inner pressure of the container 20. When the height difference H1 is too large, inward deformation of the lip section 21 is likely to occur when the environmental temperature is varied. In addition, the inward deformation of the lip section 21 is bending deformation in a direction in which the opening end surface 21*b* is moved inward in the radial direction.

If the height difference H1 is within this range, a sufficient tamper evidence property can be secured, the inward deformation of the lip section 21 can be prevented, and the sealing performance can be increased.

The opening end seal projection 13 is formed to project downward from the inner surface 2*a* (the lower surface) of the top plate section 2. A cross-sectional shape of the opening end seal projection 13 may be, for example, a semi-circular shape, an arc shape, and an oval arc shape.

The outer seal projection 14 is formed to extend downward while an inner diameter thereof is gradually reduced from the inner surface 2*a* (the lower surface) of the top plate section 2 in a distal end direction. The outer seal projection 14 may have a cylindrical plate shape. The outer seal projection 14 may be formed such that a thickness thereof is gradually reduced toward the distal end.

The inner surface 14*a* of the outer seal projection 14 becomes an inclined surface, which is inclined such that an inner diameter thereof is gradually reduced toward the distal end. The inner surface 14*a* may be inclined at a certain angle.

A lower end of the inner surface 14*a* is a minimum inner diameter section 14*d* of the outer seal projection 14.

The outer seal projection 14 is configured to abut the outer surface 21*c* throughout the entire circumference with no gap and seal the container 20 at a position at which the minimum inner diameter section 14*d* is spaced apart from the opening end surface 21*b* toward the container main body 24.

Since the outer seal projection 14 abuts the outer surface 21*c* at a position spaced apart from the opening end surface 21*b*, the distal end of the outer seal projection 14 can be followingly deformed to move inward and outward in the radial direction. For this reason, abutment with respect to the outer surface 21*c* can be maintained even when an impact is applied from the outside, and the decrease in sealing performance can be prevented.

In addition, since the abutting position with respect to the outer surface 21*c* of the outer seal projection 14 is decreased and the height difference between the abutting position of the outer seal projection 14 and the abutting position of the inner seal projection 12 is reduced, even when the environmental temperature is increased, inward deformation of the lip section 21 of the container 20 is likely to occur, and a decrease in sealing performance can be prevented.

An inner diameter of the maximum outer diameter section 14*d* may be slightly smaller than an outer diameter of the lip section 21. Accordingly, since the outer seal projection 14 abuts the outer surface 21*c* merely by being elastically bent and deformed outward, the outer seal projection 14 abuts the outer surface 21*c* with a sufficient pressing force.

A height position of the minimum inner diameter section 14*d* of the outer seal projection 14 is a position, for example, greater than or equal to that of the maximum outer diameter section 12*b* of the inner seal projection 12.

The height position of the minimum inner diameter section 14*d* may be set such that a height difference H2 between the minimum inner diameter section 14*d* and a lower end (a projection end) of the opening end seal projection 13 is 0.5 to 2 mm (preferably 1 to 1.5 mm).

When the height difference H2 is too small, inward deformation of the lip section 21 is likely to occur when the environmental temperature is varied. When the height difference H2 is too large, an inward pressing force of the outer seal projection 14 may be insufficient.

If the height difference H2 is within this range, sealability of the outer seal projection 14 can be increased, and inward deformation of the lip section 21 can be prevented even when the environmental temperature is increased.

A height difference H3 between the minimum inner diameter section 14*d* of the outer seal projection 14 and the maximum outer diameter section 12*b* of the inner seal projection 12 may be 2.5 mm or less (preferably 2 mm or less). The height difference H3 may be 0 mm or more.

If the height difference H3 is within this range, inward deformation of the lip section 21 of the container 20 can be prevented even when the environmental temperature is increased.

A distal end surface 14*b* of the outer seal projection 14 is formed such that a diameter gradually increases from a lower end of an inner surface 14*a* toward downward an outer surface 14*c*. A cross-sectional shape of the distal end surface 14*b* may be a convex shape, for example, substantially an arc shape or substantially an oval arc shape.

The outer surface 14*c* of the outer seal projection 14 becomes an inclined surface, which is inclined such that an outer diameter is gradually reduced toward the distal end. The outer surface 14*c* may be inclined at a constant angle.

An average thickness of the outer seal projection 14 (an average thickness in a range from a base end section 14*e* to the minimum inner diameter section 14*d*, i.e., a thickness T2 shown in FIG. 1A) may be 0.5 to 2 mm (preferably 1 to 1.5 mm).

If an average thickness of the outer seal projection 14 is within this range, flexibility is provided to the outer seal projection 14 to increase impact absorbing performance of the outer seal projection 14, and sufficient sealability can be obtained.

When the average thickness of the outer seal projection 14 is too small, since the elastic force is reduced, the pressing force with respect to the outer surface 21*c* is reduced and sealability is decreased. When the average thickness of the outer seal projection 14 is too large, a following deformation property is degraded, and for example, when a concave section is formed in the outer surface 21*c* due to damage or the like, sealing performance is likely to be decreased when an impact is applied to the cap 1.

A ratio between an inward pressing force Fo with respect to the outer surface 21*c* of the outer seal projection 14 and an outward pressing force Fi with respect to the inner surface 21*a* of the inner seal projection 12 may be Fo:Fi=0.5:1 to 3:1 (preferably 1:1 to 3:1). If the ratio is within this range, the inward or outward force applied to the lip section 21 can be prevented from becoming excessive, and even when the environmental temperature is increased, deformation (in particular, an inward direction) of the lip section 21 can be prevented.

Further, the inward pressing force of the outer seal projection 14 is a pressing force in a direction perpendicular to the outer surface 21*c* of FIG. 1A (leftward and rightward directions of FIG. 1A). The outward pressing force of the inner seal projection 12 is a pressing force in a direction perpendicular to the inner surface 21*a* of FIG. 1A (the leftward and rightward directions of FIG. 1A).

An engaging projection 11 serving as an engaging projection configured to engage with the engaging step section 23 of the container 20 to prevent movement of the TE ring section 9 upon uncapping is formed at the inner circumferential surface of the TE ring section 9.

The engaging projection 11 is formed to project inward from the inner circumferential surface of the TE ring section 9.

The cap 1 may be constituted of a synthetic resin material such as a high density polyethylene, polypropylene, or the like. The cap 1 can optimize the uncapping property and the capping property even when no lubricant (erucic acid amide or the like) is added.

When the cap 1 mounted on the lip section 21 is rotated in the uncapping direction, the cap 1 is raised in accordance with the rotation.

When the cap 1 is further rotated in the uncapping direction in a state in which the engaging projection 11 arrives at the lower end of the engaging step section 23, since the main section 8 is raised in accordance with the rotation and the engaging projection 11 is hooked by the engaging step section 23, upward movement of the TE ring section 9 is prevented.

As a result, a tensile force is applied to the bridge 7 that connects the main section 8 and the TE ring section 9, the bridge 7 is broken, and the TE ring section 9 is separated from the main section 8.

Accordingly, it is clear that the cap 1 has been uncapped.

In the cap 1, since the outer seal projection 14 has the inner surface 14*a* inclined such that the inner diameter is gradually reduced toward the distal end and abuts the outer surface 21*c* at the minimum inner diameter section 14*d* of the lower end of the inner surface 14*a* at a position spaced apart from the opening end surface 21*b*, a following deformation property can be provided to the outer seal projection 14.

Accordingly, the abutting state with respect to the outer surface 21*c* can be maintained even when an impact is applied from the outside, and a decrease in sealing performance can be prevented.

In general, in the cap for the container filled with the carbonated beverage, in consideration of expanding and deformation (see a two-dot chain line of FIG. 1A) of the top plate section due to the increase in container inner pressure caused by the carbonated beverage, the inner seal projection is designed to come in contact with the lip section at a relatively low position. For this reason, the height difference between the lip section pressing positions of the outer seal projection and the inner seal projection is increased, and inward deformation of the lip section is likely to occur when the environmental temperature is increased.

On the other hand, in the cap 1, since the abutting position with respect to the lip section 21 of the outer seal projection 14 is decreased and thus the height difference between the lip section 21 pressing positions of the outer seal projection 14 and the inner seal projection 12 can be reduced, even when the environmental temperature is increased, inward deformation of the lip section 21 of the container 20 can be prevented and a decrease in sealing performance can be prevented.

In addition, since the outer seal projection 14 abuts the lip section 21 at the minimum inner diameter section 14*d* closer to the distal end than the base end section, even when there is deviation of the outer diameter of the lip section 21, an excessive decrease or increase in pressing force can be prevented.

A structure in which the outer seal projection 14 abuts the lip section 21 at the minimum inner diameter section 14*d* closer to the distal end than the base end section is a structure in which the pressing force of the outer seal projection 14 with respect to the lip section 21 is easily set to a lower value in comparison with the case in which the abutting position is the base end section. Accordingly, the structure is suitable in that a ratio between the pressing force of the outer seal projection 14 and the pressing force of the inner seal projection 12 is optimized and inward deformation of the lip section 21 of the container 20 can be effectively prevented.

Since the cap 1 can decrease the inward pressing force of the outer seal projection 14 by a structure of the above-mentioned outer seal projection 14 without a decrease in sealing performance, the uncapping torque and the capping torque can be suppressed, and the uncapping property and the capping property can be optimized. For this reason, no lubricant is required.

When a lubricant is used, functions (for example, suppression of the uncapping torque and the capping torque) cannot easily be exhibited appropriately for such reasons as easy variation in a bleeding amount of the lubricant, but since the lubricant is not required in the cap 1, stable uncapping and capping properties can be obtained.

Further, in the cap 1, a phenomenon in which the carbonated beverage abruptly foams and spills out of the lip section 21 does not occur upon the uncapping. While it is not clear why the carbonated beverage is prevented from spilling out by the cap 1, it may be related to the fact that no lubricant is required.

The closure device shown in FIG. 1A and so on may be a beverage-filled closure device in which the container 20 is filled with the carbonated beverage and the cap 1 is mounted on the lip section 21.

EXAMPLE

Example 1

The cap 1 shown in FIG. 1A was manufactured. The cap 1 was formed of a high density polyethylene and no lubricant was used. The cap 1 was mounted on the lip section 21 of the container 20, and the closure device underwent a heat cycle test. A ratio (Fo:Fi) between an inward pressing force Fo with respect to the outer surface 21*c* of the outer seal projection 14 and an outward pressing force Fi with respect to the inner surface 21*a* of the inner seal projection 12 was set to 1.5:1.

In the heat cycle test, the container 20 and the cap 1 were placed under a heating condition (55° C.) for 9 hours, a process of placing them under a cooling condition (22° C.) for 15 hours was repeated two times, and then the container 20 and the cap 1 were placed under a condition of 5° C. for 24 hours.

Figure 3:
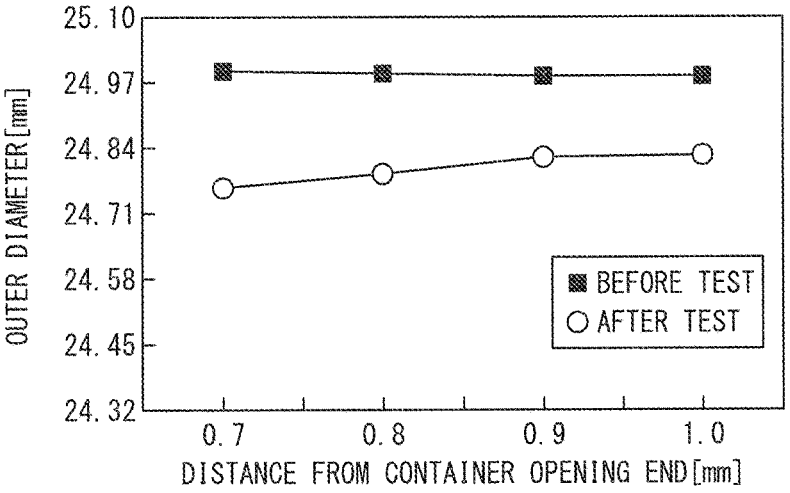
FIG. 3 is a graph showing a test result of an example.

Results of measuring the outer diameter of the lip section 21 of the container 20 before and after the heat cycle test are represented in FIG. 3. A horizontal axis of FIG. 3 represents a distance from the opening end surface 21*b* of the lip section 21 to a measurement place. For example, 0.7 mm means a position spaced 0.7 mm from the opening end surface 21*b* toward the container main body 24. A vertical axis of FIG. 3 represents an outer diameter of the lip section 21.

Comparative Example 1

Figure 7:
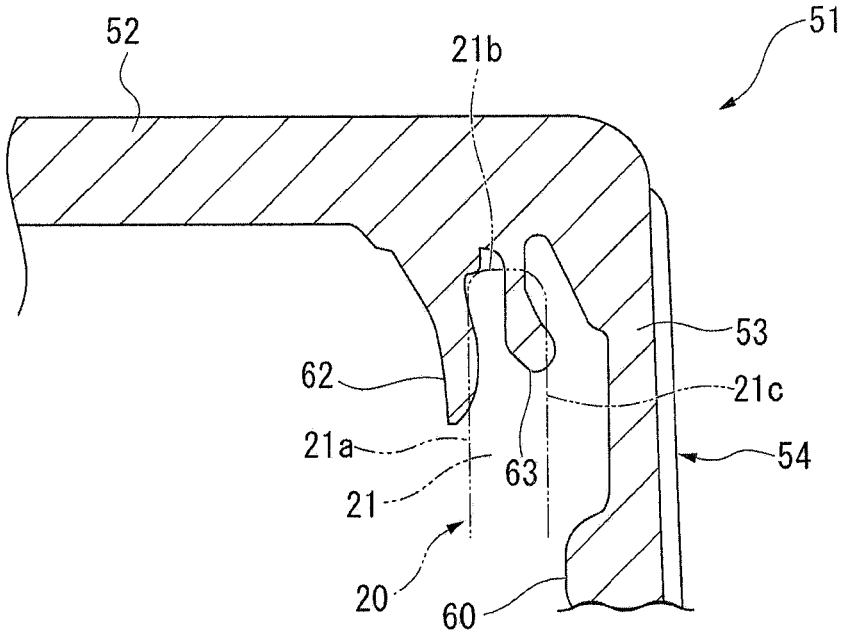
FIG. 7 (Prior Art)
FIG. 7 is an enlarged cross-sectional view showing another example of the synthetic resin cap of the related art.

The cap 51 shown in FIG. 7 was manufactured. The cap 51 was formed of a high density polyethylene, and a lubricant (erucic acid amide, an addition amount to the cap 51: 2000 mg/kg) was used.

The cap 51 was mounted on the lip section 21 of the container 20, and the closure device underwent the same heat cycle test as in Example 1. A ratio (Fo:Fi) between the inward pressing force Fo of the outer seal projection and the outward pressing force Fi of the inner seal projection was set to 6:1.

Figure 4:
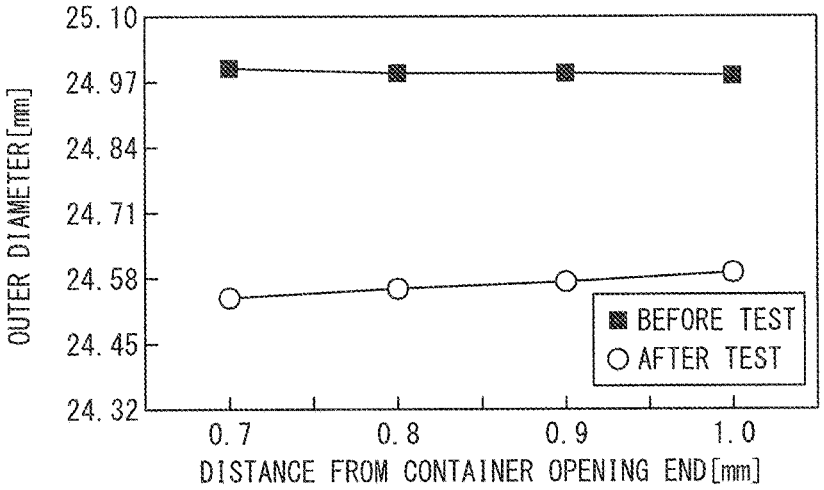
FIG. 4 is a graph showing a test result of a comparative example.

Results of measuring the outer diameter of the lip section 21 of the container 20 before and after the heat cycle test are represented in FIG. 4.

In Example 1, it is found with reference to FIGS. 3 and 4 that a variation in outer diameter of the lip section 21 by the heat cycle test can be suppressed.

Example 2

Figure 5:
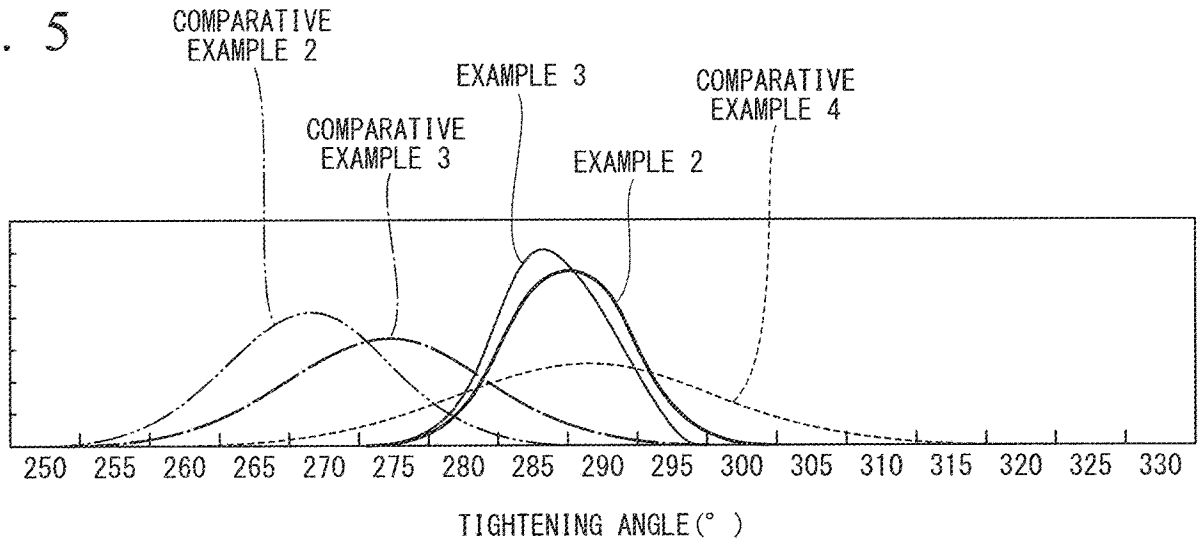
FIG. 5 is a graph showing a test result according to a tightening angle.
Figure 6:
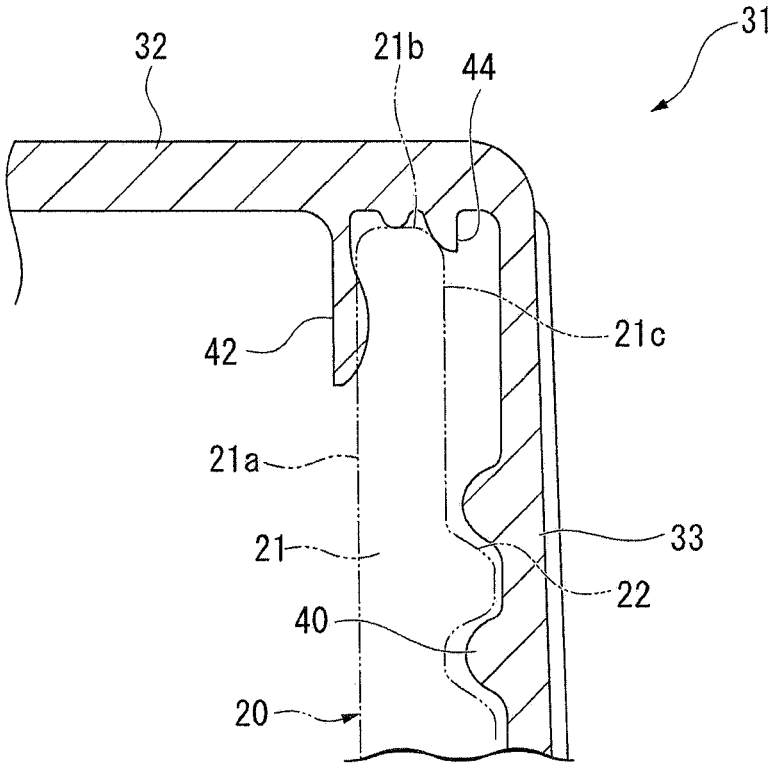
FIG. 6 (Prior Art)
FIG. 6 is an enlarged cross-sectional view showing an example of a synthetic resin cap of the related art.

A tightening angle of the same cap 1 as in Example 1 was measured. The number of samples was 25. FIG. 5 shows distribution of the tightening angle. A horizontal axis of FIG. 5 represents the tightening angle, and a vertical axis represents the number of samples.

The tightening angle refers to a rotational angle of the cap 1 when the cap 1 is mounted on the lip section 21 with a predetermined torque.

The cap 1 after manufacture was left at room temperature for 3 days, and the tightening angle was measured at room temperature.

Example 3

After manufacture of the same cap 1 as in Example 1, the cap 1 was left at room temperature for 3 days and left under the heating condition (55° C.) for 24 hours, and the tightening angle of the cap 1 was measured at room temperature. The other conditions were the same as in Example 2. Results are shown in FIG. 5.

Comparative Example 2

After manufacture of the same cap 51 as in Comparative Example 1, the cap 51 was left at room temperature for 3 days, and then the tightening angle was measured at room temperature. The other conditions were the same as in Example 2. Results are shown in FIG. 5.

Comparative Example 3

After manufacture of the same cap 51 as in Comparative Example 1, the cap 51 was left in a winter environment (an average temperature of 10° C.) for 3 days and left under a heating condition (55° C.) for 24 hours, and then the tightening angle was measured at room temperature. The other conditions were the same as in Example 2. Results are shown in FIG. 5.

Comparative Example 4

After manufacture of the same cap 51 as in Comparative Example 1, the cap 51 was left in a summer environment (an average temperature of 40° C.) for 3 days and left under a heating condition (55° C.) for 24 hours, and then the tightening angle was measured at room temperature. The other conditions were the same as in Example 2. Results are shown in FIG. 5.

With reference to FIG. 5, it is found that Examples 2 and 3 have advantages in that deviation of the tightening angle is reduced and the capping property is improved in comparison with Comparative Examples 2 to 4.

In addition, among Comparative Examples 2 to 4, the deviation is increased in Comparative Example 4 in which the cap 51 is left under a relatively high temperature condition.

The deviation of the tightening angle may be considered to occur due to the deviation of the bleeding amount of the lubricant.

In the present invention, as defined in the Japanese Agricultural Standards (JAS), carbonated beverages are beverages made by pushing carbon dioxide (carbonic acid gas) into drinking water and beverages formed by adding sweeteners, acidifiers, perfumes, or the like to the beverages. Specifically, the beverage may include a beverage to which a flavor of lemon, lime, orange, grapefruit, grape, apple, or the like, is added, ginger ale, cola, a fruit juice-containing carbonated beverage, a milk-containing carbonated beverage, carbonic acid-containing liquors (cocktails in a can or the like), sparkling wine, beer, sparkling liquor, and so on. A partial pressure of the carbon dioxide (carbonic acid gas) is, for example, 0.02 MPa or more (20° C.).

Further, the lubricant may be, for example, a hydrocarbon-based lubricant (liquid paraffin or the like), a fatty-acid-based lubricant (higher fatty acid or the like), a fatty-acid-amide-based lubricant (fatty acid amide or the like), an ester-based lubricant (lower alcohol ester or the like of a fatty acid), an alcohol-based lubricant (fatty alcohol or the like), a metal-soap-based lubricant, or the like.

REFERENCE SIGNS LIST

1: cap (synthetic resin cap for container filled with carbonated beverage)
2: top plate section
2*a*: inner surface of top plate section
3: cylindrical section
10: threaded section
12: inner seal projection
12*a*: abutting convex section
12*b*: maximum outer diameter section
12*e*: base end section
12*f*: outer surface
13: opening end seal projection
14: outer seal projection
14*a*: inner surface
14*d*: minimum inner diameter section
14*e*: base end section
20: container
21: lip section
21*a*: inner surface
21*b*: opening end surface
21*c*: outer surface
24: container main body
T2: average thickness of range from base end section of outer seal projection to minimum inner diameter section

The invention claimed is:

1. A synthetic resin cap for a container, the synthetic resin cap being configured to be mounted on a lip section of a container, the lip section having an inner surface and an outer surface, the synthetic resin cap comprising:

a top plate section having an inner surface and an outer surface;

a cylindrical section extending downward from a circumferential edge of the top plate section;

an inner seal projection being configured to abut the inner surface of the lip section of the container, the inner seal projection being formed at the inner surface of the top plate section, the inner seal projection having an inner surface and an outer surface; and an outer seal projection being configured to abut the outer surface of the lip section of the container, the outer seal projection being formed at the inner surface of the top plate section, the outer seal projection having an inner surface and an outer surface, the distance between the inner and outer surfaces of the outer seal projection narrowing towards a distal end, the inner surface of the outer seal projection being substantially perpendicular to the inner surface of the top plate section, wherein the outer surface of the inner seal projection forms an abutting convex section configured to abut the inner surface of the lip section and form a seal with the container, the abutting convex section being at a position spaced apart from an opening end section of the lip section toward a container main body, wherein the inner surface of the outer seal projection forms a minimum inner diameter section at a lower end thereof, the minimum inner diameter section abutting the outer surface of the lip section at a position spaced apart from the opening end section of the lip section toward the container main body, wherein a thickness of the outer seal projection measured perpendicular to the outer surface thereof is constantly and gradually reduced toward the distal end up to the minimum inner diameter section, wherein the inner seal projection includes a thin wall section that is thinner than other portions of the inner seal projection, the thin wall section being formed at a position close to a base end section of the inner seal projection, wherein the outer seal projection extends beyond the thin wall section toward the container main body.

2. The synthetic resin cap according to claim 1, wherein the minimum inner diameter section of the outer seal projection is disposed at a position closer to the inner surface of the top plate section than a maximum outer diameter section of the abutting convex section of the inner seal projection.

3. The synthetic resin cap according to claim 2, wherein a height difference between the minimum inner diameter section and the maximum outer diameter section is 2.5 mm or less.

4. The synthetic resin cap according to claim 1, wherein the outer seal projection is formed in a plate shape.

5. The synthetic resin cap according to claim 4, wherein the outer seal projection has an average thickness from a base end section to the minimum inner diameter section of 0.5 to 2 mm.

6. The synthetic resin cap according to claim 1, wherein a ratio between an inward pressing force of the outer seal projection and an outward pressing force of the inner seal projection is 0.5:1 to 3:1, wherein the inward pressing force is a pressing force in a direction perpendicular to the outer surface of the lip section, and the outward pressing force being a pressing force in a direction perpendicular to the inner surface of the lip section.

7. The synthetic resin cap according to claim 1, wherein the thin wall section is in a range of 1.0 to 2.2 mm.

8. The synthetic resin cap according to claim 7, wherein the thin wall section is in a range of 1.4 to 1.8 mm.

9. The synthetic resin cap according to claim 1, wherein the thin wall section is configured to be flexible enough to prevent the inner seal projection from being deformed and stiff enough to fit the inner seal projection into the lip section of the container.

10. The synthetic resin cap according to claim 1, wherein a maximum diameter of the outer seal projection is substantially identical to an outer diameter of the lip section of the container.

11. The synthetic resin cap according to claim 1, wherein the outer seal projection is configured to abut the outer surface of the lip section by being elastically bent and deformed outward while keeping the outer diameter gradually reduced toward the distal end.

12. The synthetic resin cap according to claim 1, wherein the thickness of the outer seal projection measured perpendicular to the outer surface thereof is constantly and gradually reduced toward the distal end up to the minimum inner diameter section such that a following deformation property is provided to the outer seal projection.

13. A container assembly, comprising:

a carbonated beverage-filled container, the container including a main container body and a lip section, the lip section having an inner surface and an outer surface;

a synthetic resin cap that is configured to be mounted on the lip section of the container, including:

a top plate section having an inner surface and an outer surface;

a cylindrical section extending downward from a circumferential edge of the top plate section;

an inner seal projection being configured to abut the inner surface of the lip section of the container, the inner seal projection being formed at the inner surface of the top plate section, the inner seal projection having an inner surface and an outer surface; and an outer seal projection being configured to abut the outer surface of the lip section of the container, the outer seal projection being formed at the inner surface of the top plate section the outer seal projection having an inner surface and an outer surface, the distance between the inner and outer surfaces of the outer seal projection narrowing towards a distal end, the inner surface of the outer seal projection being substantially perpendicular to the inner surface of the top plate section, wherein the outer surface of the inner seal projection forms an abutting convex section configured to abut the inner surface of the lip section and form a seal with the container, the abutting convex section being at a position spaced apart from an opening end section of the lip section toward a container main body, wherein the inner surface of the outer seal projection forms a minimum inner diameter section at a lower end thereof, the minimum inner diameter section abutting the outer surface of the lip section at a position spaced apart from the opening end section of the lip section toward the container main body, wherein a thickness of the outer seal projection measured perpendicular to the outer surface thereof is constantly and gradually reduced toward the distal end up to the minimum inner diameter section, wherein the inner seal projection includes a thin wall section that is thinner than other portions of the inner seal projection, the thin wall section being formed at a position close to a base end section of the inner seal projection, wherein the outer seal projection extends beyond the thin wall section toward the container main body.

14. The container assembly of claim 13, wherein the container is a carbonated beverage-filled container.

15. The container assembly of claim 13, wherein the minimum inner diameter section of the outer seal projection is positioned closer to the inner surface of the top plate section than a maximum outer diameter section of the abutting convex section of the inner seal projection.

16. The container assembly of claim 15, wherein a height difference between the minimum inner diameter section and the maximum outer diameter section is 2.5 mm or less.

17. The container assembly of claim 13, wherein the outer seal projection is formed in a plate shape.

18. The container assembly of claim 17, wherein the outer seal projection has an average thickness from a base end section to the minimum inner diameter section of 0.5 to 2 mm.

19. The container assembly of claim 13, wherein the thin wall section is in a range of 1.0 to 2.2 mm.

20. The container assembly of claim 19, wherein the thin wall section is in a range of 1.4 to 1.8 mm.

21. The container assembly of claim 13, wherein the thickness of the outer seal projection measured perpendicular to the outer surface thereof is constantly and gradually reduced toward the distal end up to the minimum inner diameter section such that a following deformation property is provided to the outer seal projection.

22. A synthetic resin cap for a container, the synthetic resin cap being configured to be mounted on a lip section of a container, the lip section having an inner surface and an outer surface, the synthetic resin cap comprising:

a top plate section having an inner surface and an outer surface;

a cylindrical section extending downward from a circumferential edge of the top plate section;

an inner seal projection being configured to abut the inner surface of the lip section of the container, the inner seal projection being formed at the inner surface of the top plate section, the inner seal projection having an inner surface and an outer surface; and an outer seal projection being configured to abut the outer surface of the lip section of the container, the outer seal projection being formed at the inner surface of the top plate section, the outer seal projection having an inner surface and an outer surface, the distance between the inner and outer surfaces of the outer seal projection narrowing towards a distal end, the inner surface of the outer seal projection being substantially perpendicular to the inner surface of the top plate section, wherein the outer surface of the inner seal projection forms an abutting convex section configured to abut the inner surface of the lip section and form a seal with the container, the abutting convex section being at a position spaced apart from an opening end section of the lip section toward a container main body, wherein the inner surface of the outer seal projection forms a minimum inner diameter section at a lower end thereof, the minimum inner diameter section abutting the outer surface of the lip section at a position spaced apart from the opening end section of the lip section toward the container main body, wherein a thickness of the outer seal projection measured perpendicular to the outer surface thereof is constantly and gradually reduced toward the distal end up to the minimum inner diameter section, wherein the inner seal projection includes a thin wall section that is thinner than other portions of the inner seal projection, the thin wall section being formed at a position close to a base end section of the inner seal projection, wherein the outer seal projection extends beyond the thin wall section toward the container main body, wherein the outer seal projection has a distal end opposite of the top plate, a surface of the distal end being curved so as to be convex, the diameter of the outer seal projection gradually decreasing as the inner surface of the outer seal projection approaches and contacts the outer surface of the outer seal projection at the distal end.

23. The synthetic resin cap of claim 22, wherein the minimum inner diameter section of the outer seal projection is positioned closer to the inner surface of the top plate section than a maximum outer diameter section of the abutting convex section of the inner seal projection.

24. The synthetic resin cap of claim 23, wherein a height difference between the minimum inner diameter section and the maximum outer diameter section is 2.5 mm or less.

25. The synthetic resin cap of claim 22, wherein the outer seal projection is formed in a plate shape.

26. The synthetic resin cap of claim 25, wherein the outer seal projection has an average thickness from a base end section to the minimum inner diameter section of 0.5 to 2 mm.

27. The synthetic resin cap of claim 22, wherein the thin wall section is in a range of 1.0 to 2.2 mm.

28. The synthetic resin cap of claim 27, wherein the thin wall section is in a range of 1.4 to 1.8 mm.

29. The synthetic resin cap of claim 22, wherein the thickness of the outer seal projection measured perpendicular to the outer surface thereof is constantly and gradually reduced toward the distal end up to the minimum inner diameter section such that a following deformation property is provided to the outer seal projection.

30. A container assembly, comprising:

a container including a main container body and a lip section, the lip section having an inner surface and an outer surface;

a synthetic resin cap that is configured to be mounted on the lip section of the container including:

a top plate section having an inner surface and an outer surface;

a cylindrical section extending downward from a circumferential edge of the top plate section;

an inner seal projection being configured to abut the inner surface of the lip section of the container, the inner seal projection being formed at the inner surface of the top plate section, the inner seal projection having an inner surface and an outer surface; and an outer seal projection being configured to abut the outer surface of the lip section of the container, the outer seal projection being formed at the inner surface of the top plate section, the outer seal projection having an inner surface and an outer surface, the distance between the inner and outer surfaces of the outer seal projection narrowing towards a distal end, the inner surface of the outer seal projection being substantially perpendicular to the inner surface of the top plate section, wherein the outer surface of the inner seal projection forms an abutting convex section configured to abut the inner surface of the lip section and form a seal with the container, the abutting convex section being at a position spaced apart from an opening end section of the lip section toward a container main body, wherein the inner surface of the outer seal projection forms a minimum inner diameter section at a lower end thereof, the minimum inner diameter section abutting the outer surface of the lip section at a position spaced apart from the opening end section of the lip section toward the container main body, wherein a thickness of the outer seal projection measured perpendicular to the outer surface thereof is constantly and gradually reduced toward the distal end up to the minimum inner diameter section, wherein the inner seal projection includes a thin wall section that is thinner than other portions of the inner seal projection, the thin wall section being formed at a position close to a base end section of the inner seal projection, wherein the outer seal projection extends beyond the thin wall section toward the container main body, wherein the outer seal projection has a distal end opposite of the top plate, a surface of the distal end being curved so as to be convex, the diameter of the outer seal projection gradually decreasing as the inner surface of the outer seal projection approaches and contacts the outer surface of the outer seal projection at the distal end.

31. The container assembly of claim 30, wherein the beverage-filled container is a carbonated beverage-filled container.

32. The container assembly of claim 30, wherein the minimum inner diameter section of the outer seal projection is positioned closer to the inner surface of the top plate section than a maximum outer diameter section of the abutting convex section of the inner seal projection.

33. The container assembly of claim 32, wherein a height difference between the minimum inner diameter section and the maximum outer diameter section is 2.5 mm or less.

34. The container assembly of claim 30, wherein the outer seal projection is formed in a plate shape.

35. The container assembly of claim 34, wherein the outer seal projection has an average thickness from a base end section to the minimum inner diameter section of 0.5 to 2 mm.

36. The container assembly of claim 30, wherein the thin wall section is in a range of 1.0 to 2.2 mm.

37. The container assembly of claim 36, wherein the thin wall section is in a range of 1.4 to 1.8 mm.

38. The container assembly of claim 30, wherein the thickness of the outer seal projection measured perpendicular to the outer surface thereof is constantly and gradually reduced toward the distal end up to the minimum inner diameter section such that a following deformation property is provided to the outer seal projection.

* * * * *